US008230944B2

(12) United States Patent
Thiem

(10) Patent No.: US 8,230,944 B2
(45) Date of Patent: Jul. 31, 2012

(54) POST ALIGNMENT TOOL

(76) Inventor: Wayne R. Thiem, Bozeman, MT (US)

( * ) Notice: Subject to any disclaimer, the term of this patent is extended or adjusted under 35 U.S.C. 154(b) by 343 days.

(21) Appl. No.: 12/546,846

(22) Filed: Aug. 25, 2009

(65) Prior Publication Data

US 2011/0049451 A1 Mar. 3, 2011

(51) Int. Cl.
*E21B 19/00* (2006.01)

(52) U.S. Cl. ..... 173/90; 173/29; 254/30; 254/132

(58) Field of Classification Search ..... 173/90, 173/91, 132, 29, 171, 128; 254/29 R, 30, 254/131, 132
See application file for complete search history.

(56) References Cited

U.S. PATENT DOCUMENTS

| | | | | | |
|---|---|---|---|---|---|
| 1,202,551 | A | * | 10/1916 | MacKenzie | 173/29 |
| 1,916,463 | A | * | 7/1933 | Carrel | 254/132 |
| 3,280,455 | A | * | 10/1966 | Smith | 29/254 |
| 3,670,468 | A | | 6/1972 | Cordell, Sr. | |
| D224,080 | S | * | 7/1972 | Lawson | D8/14 |
| 3,762,687 | A | * | 10/1973 | De Rome et al. | 254/30 |
| 3,815,875 | A | * | 6/1974 | Koebel, Jr. | 254/132 |
| 4,561,636 | A | | 12/1985 | Moreland et al. | |
| 4,917,154 | A | | 4/1990 | Roberson, Sr. | |
| D312,196 | S | | 11/1990 | Norona | |
| 5,009,394 | A | * | 4/1991 | Marshall | 254/30 |
| 5,022,632 | A | * | 6/1991 | Beideck | 254/30 |
| 5,042,591 | A | | 8/1991 | Hull | |
| 5,048,999 | A | | 9/1991 | Wurl | |
| D337,412 | S | | 7/1993 | Ruggles | |
| 5,499,795 | A | * | 3/1996 | Mathews | 254/30 |
| 5,681,030 | A | * | 10/1997 | Nall | 254/30 |
| 5,713,559 | A | * | 2/1998 | McClarin et al. | 254/124 |
| 5,720,114 | A | | 2/1998 | Guerin | |
| 5,909,910 | A | | 6/1999 | Shaffer | |
| D431,431 | S | | 10/2000 | Allen et al. | |
| 6,247,553 | B1 | | 6/2001 | Jones | |
| 6,296,233 | B1 | | 10/2001 | Berg et al. | |
| 6,394,228 | B1 | | 5/2002 | Stephens et al. | |
| 6,619,627 | B2 | | 9/2003 | Salisbury et al. | |
| 6,719,261 | B2 | | 4/2004 | Wadsworth | |
| 6,960,728 | B1 | | 11/2005 | Halderman | |
| 7,111,690 | B2 | | 9/2006 | Kleinert | |
| 7,185,880 | B1 | | 3/2007 | McCray | |
| D623,910 | S | * | 9/2010 | Botkin | D8/14 |
| 2002/0134043 | A1 | | 9/2002 | Winterfeld | |
| 2007/0181320 | A1 | | 8/2007 | Mason | |

* cited by examiner

*Primary Examiner* — Scott A. Smith
(74) *Attorney, Agent, or Firm* — Sheridan Ross P.C.

(57) ABSTRACT

An alignment tool for aligning fence posts and a method for aligning fence posts are provided. The alignment tool can include an alignment plate with an aperture adapted to receive a fence post. The alignment plate is interconnected to a lever arm to facilitate the application of a torque to a fence post received by the aperture of the alignment plate at a desired location along the length of the fence post. The alignment plate can additionally include one or more notches adapted to receive an edge of a fence post. By applying a force through the lever arm, the portion of an edge of the fence post received by the notch can be crimped and/or otherwise aligned at a desired location along the length of the fence post. The lever arm can comprise a post pounder, resulting in a tool that is capable of performing multiple functions.

4 Claims, 6 Drawing Sheets

POST ALIGNMENT TOOL

FIELD

The present invention is directed to the alignment of posts. In particular, the present invention is directed to positioning T-posts used in fencing.

BACKGROUND

Fencing systems have long been necessary to demarcate property lines and restrict movement of persons or animals across boundaries. Fences may be used to contain persons, exclude intruders, restrict livestock, and cordon off dangerous areas. A brief survey of fencing systems reveals agricultural, privacy, perimeter, decorative, and boundary fencing, all designed to serve either symbolic or functional purposes. Indeed, many fencing systems serve both purposes, as the fence's appearance may impart notice of its purpose and therefore the use being made of the land within the fence's borders.

Fences may comprise several varieties depending on the purpose and appearance desired. Certain fencing systems may comprise pickets or posts driven into the ground and fencing wire or other material running between the posts. A familiar example of such a system is the T-post fence, in which the posts are often cruciform or T-shaped.

T-post fencing systems generally provide a cost-effective and durable fence with relative ease of installation. T-posts may be known by other names including Y-posts and star-posts, but all generally share a T-shaped or cruciform cross section. This cross section may be of a lower-case or upper-case T-shape, or various other configurations. The T-posts are often fabricated from steel, although other materials may be used, including wood. The T-post may include notches, protrusions or holes along its length to accommodate fencing or fence clips, and a plate or flange along the bottom portion to accommodate driving the post into the ground and stabilizing the post thereafter.

Various tools may facilitate driving the T-post or other fence post into the ground. Such tools, or pounders, may comprise a cylinder or hollow member with closed and open ends adapted to encompass and drive a post. Other pounders may further comprise a traveling member or sleeve adapted to travel over the hollow member and ram the closed end of the hollow member into the post. The magnitude of the force required to drive the post may depend on several factors, including the soil type and concentration of rocks. Other tools known to those of skill in the art facilitate the pulling or removing of posts from the ground.

Once the posts are driven into the ground, fencing is often strung between the posts. Several devices facilitate the attachment of the fencing to the posts, most notably fence clips that attach to the posts and guide the fencing. Fencing may comprise plain wire, barbed wire, or more elaborate systems such as mesh fencing. Corner posts may be installed to brace or anchor the fence. Fence clips may comprise simple wire twisted around the post to secure the fencing, or pre-fabricated clips that the user applies to the post to accommodate the fencing.

During installation, fence posts are often misaligned or bent. Those of skill in the art will appreciate the problems associated with misaligned fence posts. By way of illustration, a misaligned post may compromise the integrity of the fencing wire. If the post is not aligned correctly, fencing wire will travel in a crooked fashion, thereby creating unwanted stress points throughout the fence. The wire or fencing may rest against an edge of the post rather than along its side, subjecting the fencing to fraying or breakage. Animals, intruders or inclement weather may all apply further stress to the fence, often causing breakage and incurring damage, lost livestock, or danger to people and animals.

To correct a misaligned post, an adjustable wrench is often applied. However, this approach often proves ill-suited or dangerous. For example, the opening of the wrench is often not suited to the post and may slip, damaging or further misaligning the post, or worse, injuring the user. In addition, adjustable wrenches are often not of a proper length to facilitate properly adjusting a fence post. Appreciable force is generally required to drive the post into the ground. The driving of multiple posts may therefore quickly fatigue the user, making the situation increasingly dangerous.

In addition, portions of the post may become warped or deformed after installation, or the post may simply have been manufactured defectively. The defect may subsist only in an edge of the post, or the post may be bowed across its length. An adjustable wrench or other device may again be applied to correct such defects, but this approach is rarely successful given that the wrench is seldom of the proper size or shape. Once deformed, therefore, the warped post must often be pulled and discarded in favor of a conforming post.

SUMMARY

The present invention is directed to solving these and other problems and disadvantages of the prior art. In accordance with embodiments of the present invention, an alignment tool that includes a lever arm interconnected to an alignment plate is provided. The alignment plate is designed to accept a fence post through a center aperture. Accordingly, the aperture may be cruciform or T-shaped to encompass a T-post. A notch in the periphery of the alignment plate may be provided for crimping or otherwise correcting defects or inconsistencies in the T-post. In accordance with at least some embodiments, the alignment tool is operable both to drive a post into the ground and rotationally align or position the driven post. Handles extending along the length of the lever arm may be provided to facilitate driving or rotating the post.

In accordance with further embodiments of the present invention, a method for adjusting fence posts is provided, comprising placing a plate with an aperture formed therein around some or all of a post and applying, through a lever arm, a torque to twist the post into a new rotational alignment. According to some embodiments, the user may drive the post, crimp a portion of the post, attach fence clips, or attach fencing.

Additional features and advantages of embodiments of the present invention will become more readily apparent from the following description, particularly when taken together with the accompanying drawings.

DETAILED DESCRIPTION

Figure 1:
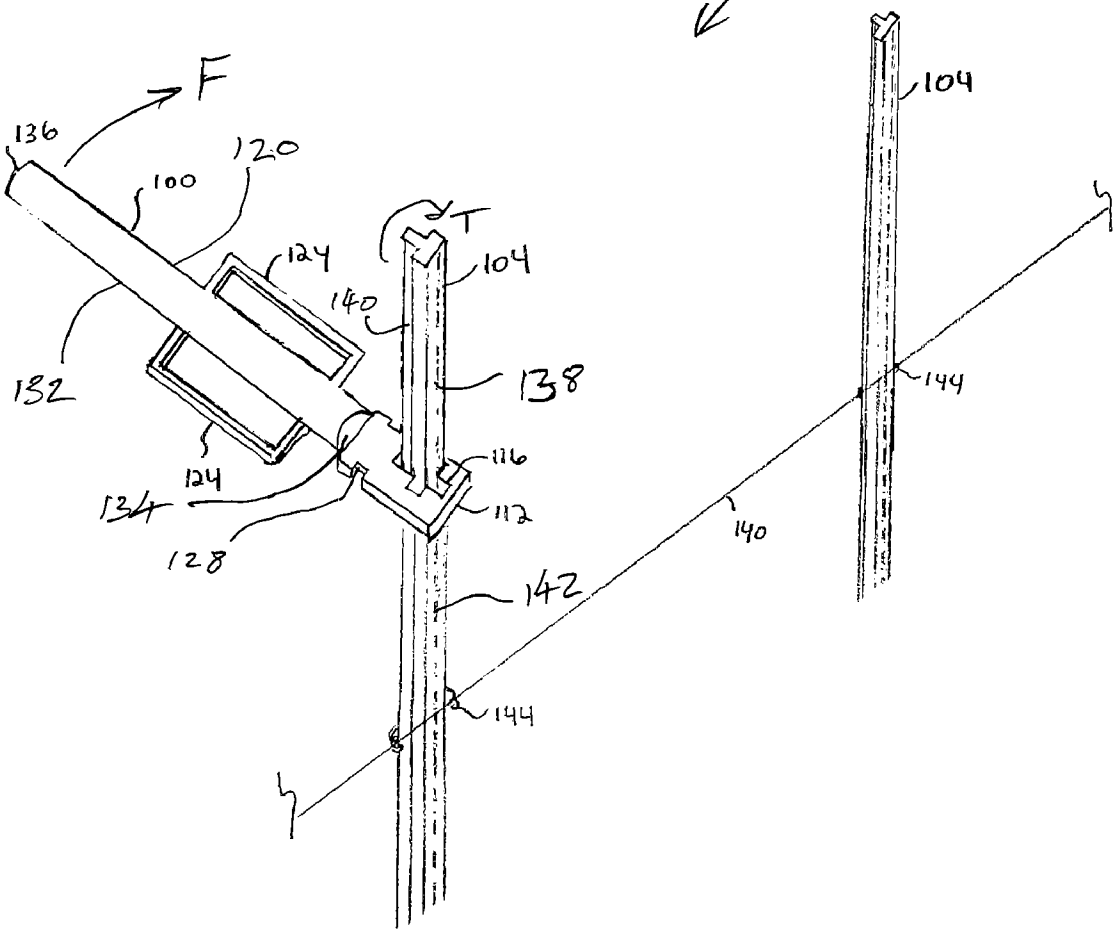
FIG. 1 is a perspective view of a fence line and an alignment tool in accordance with embodiments of the present invention.

FIG. 1 depicts an alignment tool or apparatus for aligning posts 100 in accordance with embodiments of the present invention, adjusting a fence post 104 of a fence line 108. As shown, the alignment tool 100 generally includes an alignment plate 112 with an aperture 116 formed therein that is sized such that it can be placed over a fence post 104. The alignment plate 112 is interconnected to a lever arm 120. More particularly, the lever arm 120 is fixed to the alignment plate 112 such that, by manually applying a force F within a plane that is within or nearly parallel to (e.g., −45° to +45°) a plane that is orthogonal to the longitudinal axis of the fence post 104 encompassed by the aperture 116 of the alignment plate 112, a torque T can be applied to the fence post 104. Although illustrated in the figure as applying a torque in a clockwise direction, it should be appreciated that a torque in a counterclockwise direction can also be applied, by applying a force to the lever arm 120 in the opposite direction to that shown. Accordingly, the alignment tool 100, by applying a torque T to a fence post 104, can be used to align the front plate or face 138 of the fence post so that it is parallel to the fence line and the fencing 140 supported by the fence post 104. Therefore, kinks or other stress risers that might be formed as a result of misalignment of a fence post 104 can be avoided.

In accordance with embodiments of the present invention, the alignment tool 100 may incorporate other features and/or functionalities. For example, the alignment plate 112 may include notches 128 formed in a periphery of the alignment plate that can be used to engage a flange of the fence post 104. As a further example, the lever arm 120 may comprise a post pounder 132 with a closed end 134 that is joined to the alignment plate 112, and an open end 136 opposite the closed end 134. The alignment tool 100 can also include handles 124.

As can be appreciated by one of skill in the art, the fence line 108 can include a plurality of fence posts 104. For example, as shown, the fence post 104 can comprise T-posts that include a planar front plate or face 138 and a back or stiffening flange 140. Moreover, support lugs or protrusions 142 can be formed at intervals along the face 138 of the fence post 104 to provide a mechanical stop that assists in maintaining the fencing 140 at a desired height above the ground. Fence clips 144 may be used to secure the fencing 140 to the fence post 104.

Figure 2:
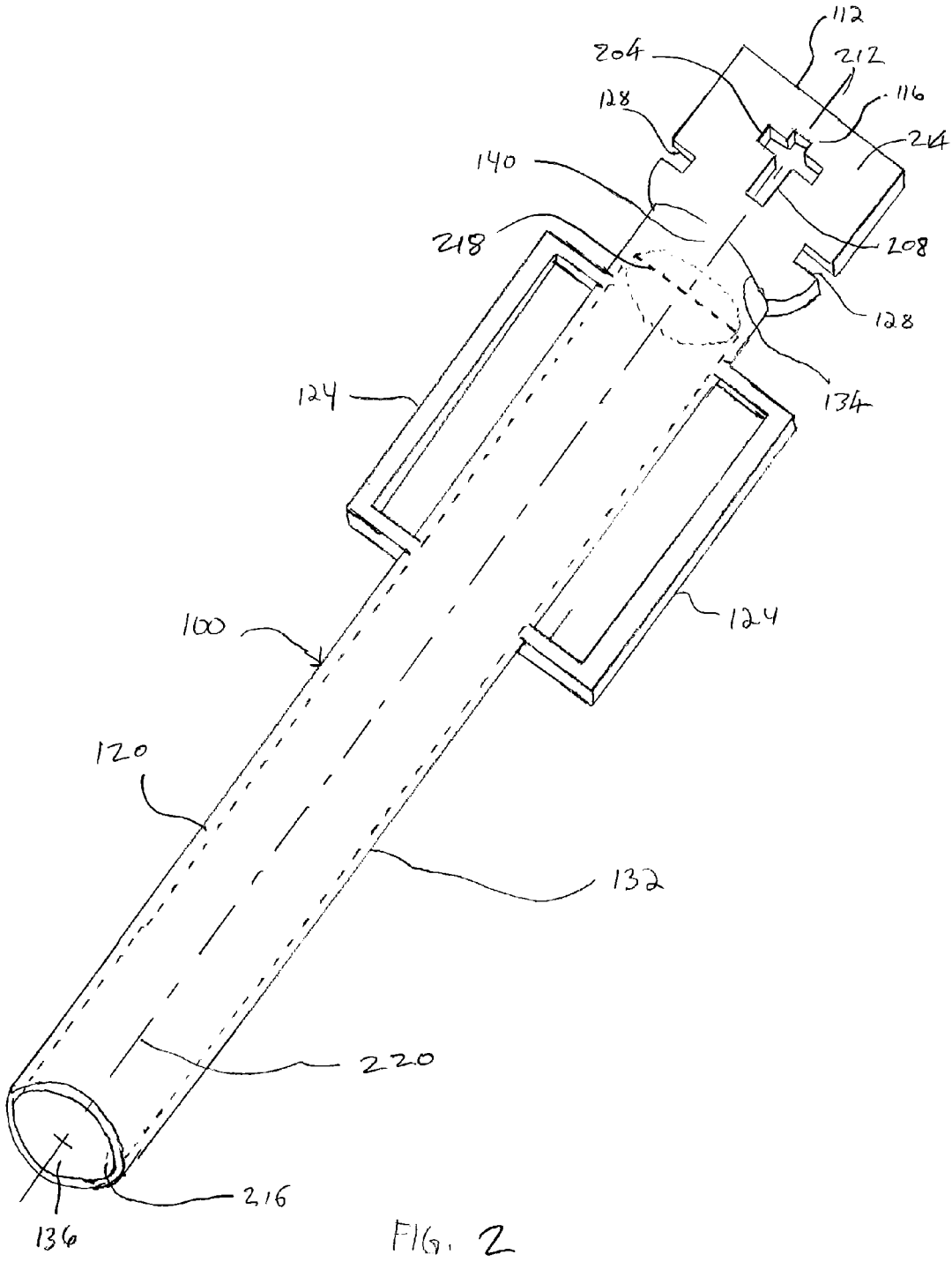
FIG. 2 is a perspective view of an alignment tool in accordance with embodiments of the present invention.

FIG. 2 is a perspective view of an alignment tool 100 in accordance with embodiments of the present invention. As shown, the aperture 116 in the alignment plate 112 is shaped to receive a fence post 104. More particularly, the aperture 116 includes a lateral slot 204 to receive the front plate 138 of a T-post 104. Moreover, a longitudinal slot 208 that intersects the lateral slot 204 is provided to receive the stiffening flange 140 of the fence post 104. Accordingly, the lateral slot 204 and the longitudinal slot 208 combine to form a T-shaped aperture 116. In the embodiment illustrated in FIG. 2, the aperture 116 also features a notch 212 that allows the aperture 116 to clear the support lugs 142 formed on the front plate 138 of a T-post 104. Accordingly, with the inclusion of the notch 212, the aperture 116 has a cruciform shape or lowercase t shape. In addition, this exemplary embodiment includes a notch 128 on either side of the alignment plate 112 sized to receive an edge of the T-post 104. For example, an edge of the front plate 138 or the edge of the stiffening flange 140 can be received by a notch 128.

The lever arm 120 in this exemplary embodiment comprises a post pounder or driver 132. Accordingly, the lever arm 120 is generally cylindrical and features an internal bore 216 that can receive a fence post 104 through the open end 136. The bore 216 terminates at a stop 218 proximate to the end 134 of the post pounder 132 that is attached to the alignment plate 112. Accordingly, as can be appreciated by one of skill in the art, by placing the post pounder 132 over a fence post 104, such that the fence post 104 is received by the bore 216, a user can drive the fence post 104 into the ground by lifting the post pounder 132 and then dropping the post pounder 132 such that the stop 218 or closed end 134 impacts the top of the T-post 104. Handles 124 may be provided to facilitate driving a fence post 104 using the post pounder 132. In accordance with still other embodiments, the handles 124 may be interconnected to a traveling member that allows an impact force to be applied without requiring movement of the T-post pounder bore 216 with respect to the fence post 104.

The alignment plate 112 may be joined to the end 134 of the lever arm 120 through any suitable means including mechanical attachment and/or welding. Moreover, the alignment plate 112 may be interconnected to an otherwise conventional post pounder 132, or to a plain lever arm 120. In addition, although the alignment plate 112 in the illustrated example lies parallel to and generally along the longitudinal axis 220 of the lever arm 120, other configurations are possible. For example, the plane defined by the top surface 214 of the alignment plate 112 can be at an angle with respect to the longitudinal axis of the lever arm 120. For instance, the plane defined by the top surface 214 of the alignment plate 112 may be at an angle of from +45° to −45° with respect to the longitudinal axis of the lever arm 120. Alternatively or in addition, although the longitudinal slot 208 of the aperture 116 is illustrated as being parallel to the longitudinal axis 220 of the lever arm 120, other configurations are possible. For instance, the longitudinal slot 208 can be at an angle of from 0° to 90° with respect to the longitudinal axis of the lever arm 120.

Figure 3:
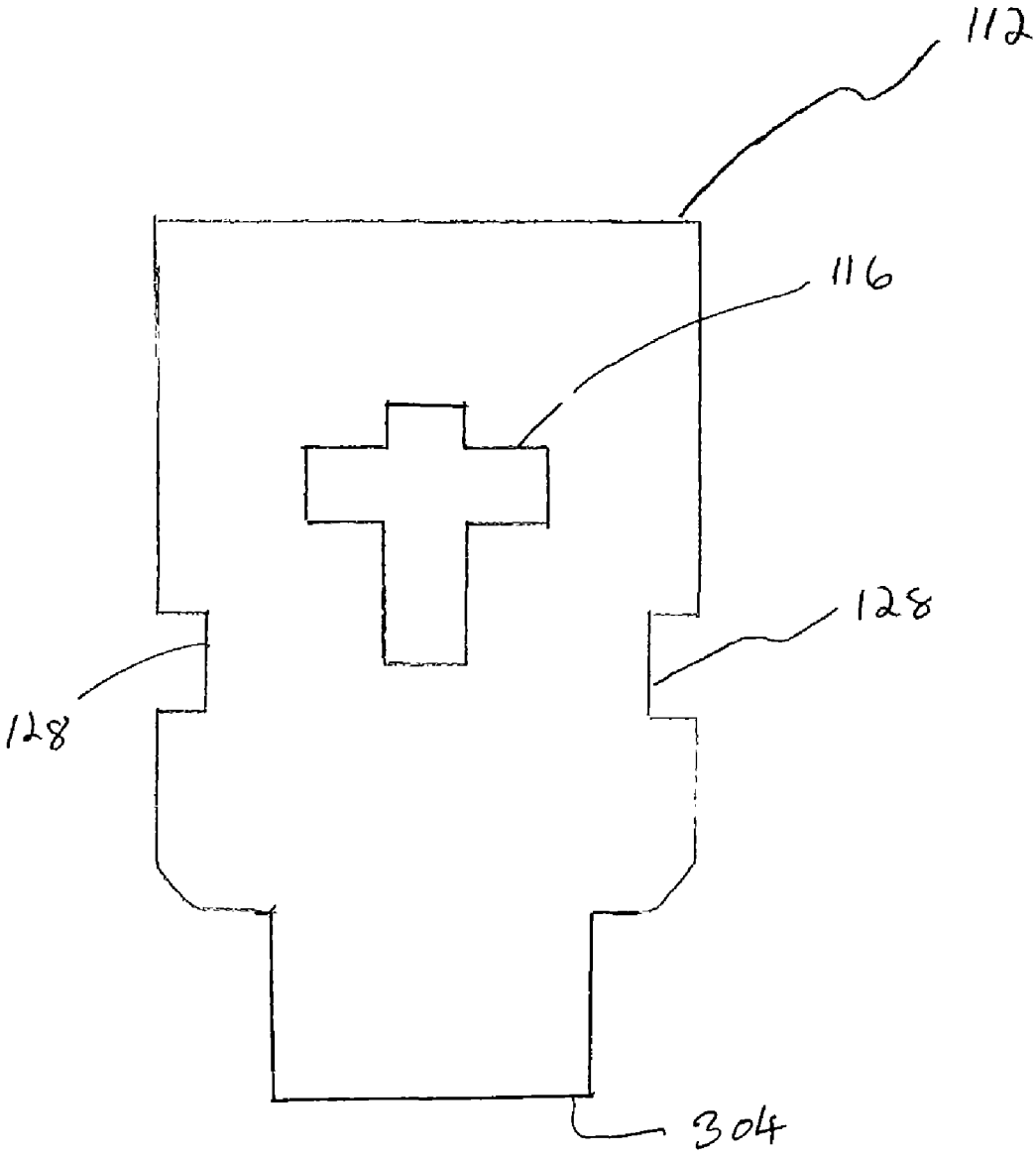
FIG. 3 is a plan view of an alignment plate of an alignment tool in accordance with embodiments of the present invention.

FIG. 3 illustrates an alignment plate 112 in accordance with embodiments of the present invention in plan view. Shown in FIG. 3 is an optional attachment tang or projection 304. As can be appreciated by one of skill in the art after consideration of the present disclosure, the inclusion of an attachment tang 304 can facilitate fixing the alignment plate 112 to a lever arm 120. For example, the tang 304 can be sized to fit inside the bore 216 of a cylindrical lever arm 120. Moreover, attaching the alignment plate 112 to a cylindrical lever arm 120 can effectively form a closed end 134 of the lever arm 120, and/or form a stop 218 to allow use of the alignment tool 100 as a post pounder.

Figure 4:
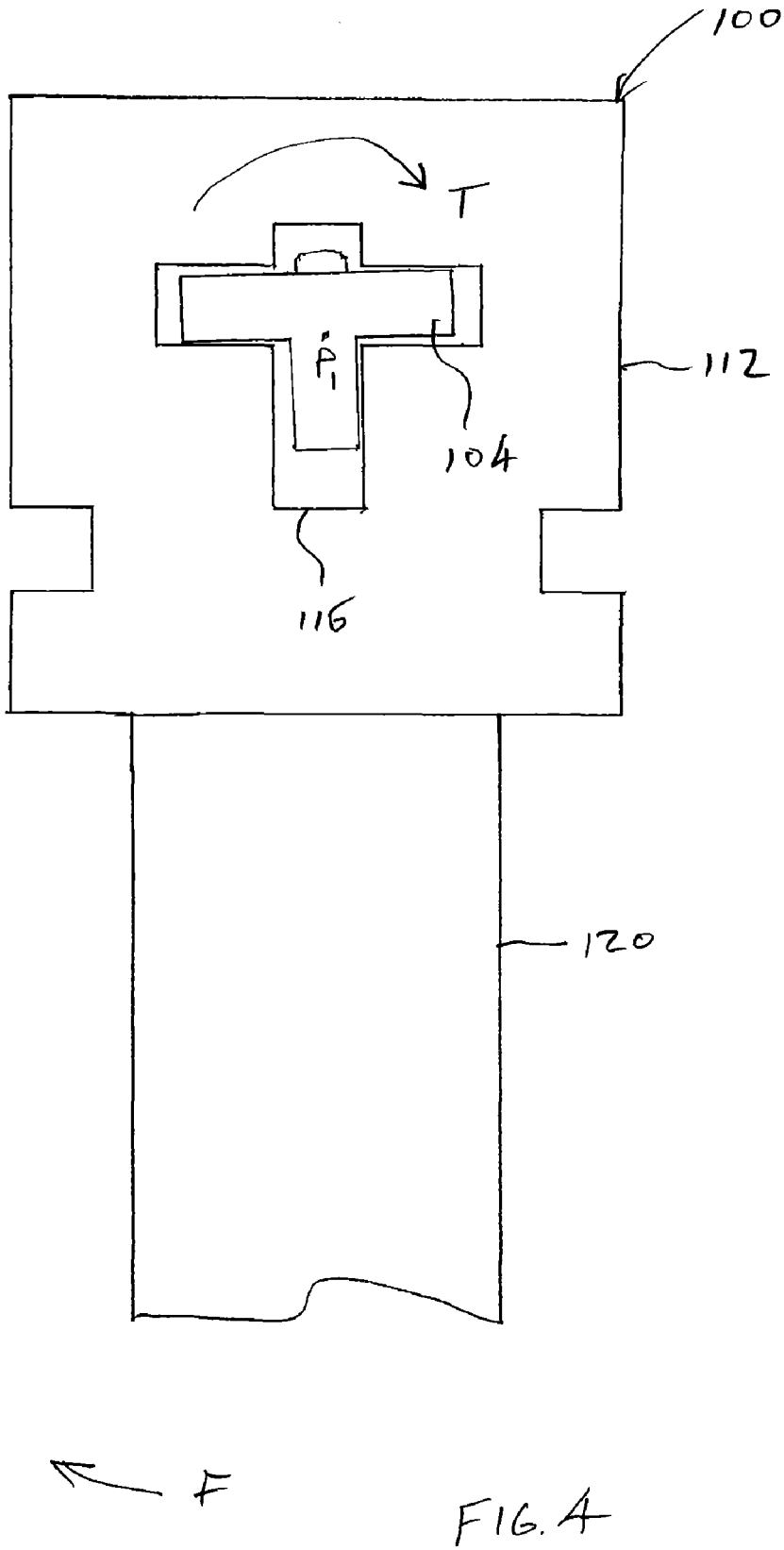
FIG. 4 is a partial plan view of an alignment tool in accordance with embodiments of the present invention straightening a T-post.

FIG. 4 is a partial plan view of an alignment tool 100 placed over a fence post 104, such that the fence post 104 is received by the aperture 116. More particularly, the alignment tool 100 is shown applying a torque T to the fence post 104 as the result of a force F applied through the lever arm 120. Accordingly, by receiving the fence post 104 in the aperture 116, the fence post 104 is securely held by the aperture 116 of the alignment plate 112, allowing a user to apply a torque T about a point $P_1$ to align the fence post 104.

Figure 5:
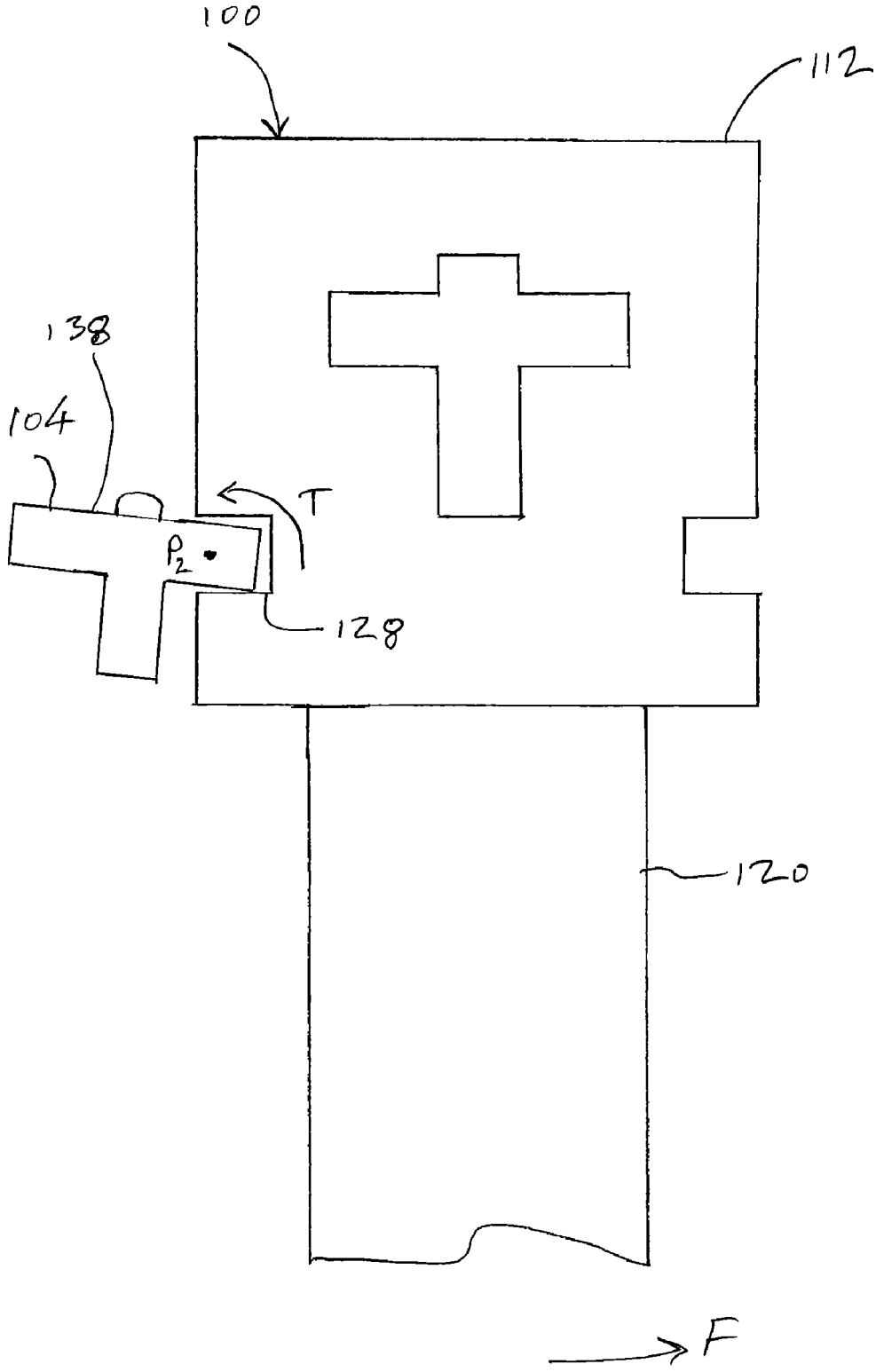
FIG. 5 is a partial plan view of an alignment tool in accordance with embodiments of the present invention crimping a portion of a T-post.

FIG. 5 is a partial plan view of an alignment tool 100 in accordance with embodiments of the present invention, and in particular illustrates the use of a notch 128 in the alignment plate 112 to engage an edge of a fence post 104. More particularly, in this example, an edge of the front plate 138 is engaged by the notch 128, such that a torque T is applied about a point $P_2$ by applying a force F through the lever arm 120. Although shown engaging a first side edge of the front plate 138, a notch 128 can also be used to engage a second side edge of the front plate, a back edge of the back flange 140, or a top edge of the front plate 138 or back flange 140. Moreover, any of the edges of the fence post 104 can be engaged by either of the notches 128. As can be appreciated by one of skill in the art, the alignment tool 100 can thus be used to straighten out edges of a fence post 104, for example that have been bent while the fence post 104 was being driven into the ground.

Figure 6:
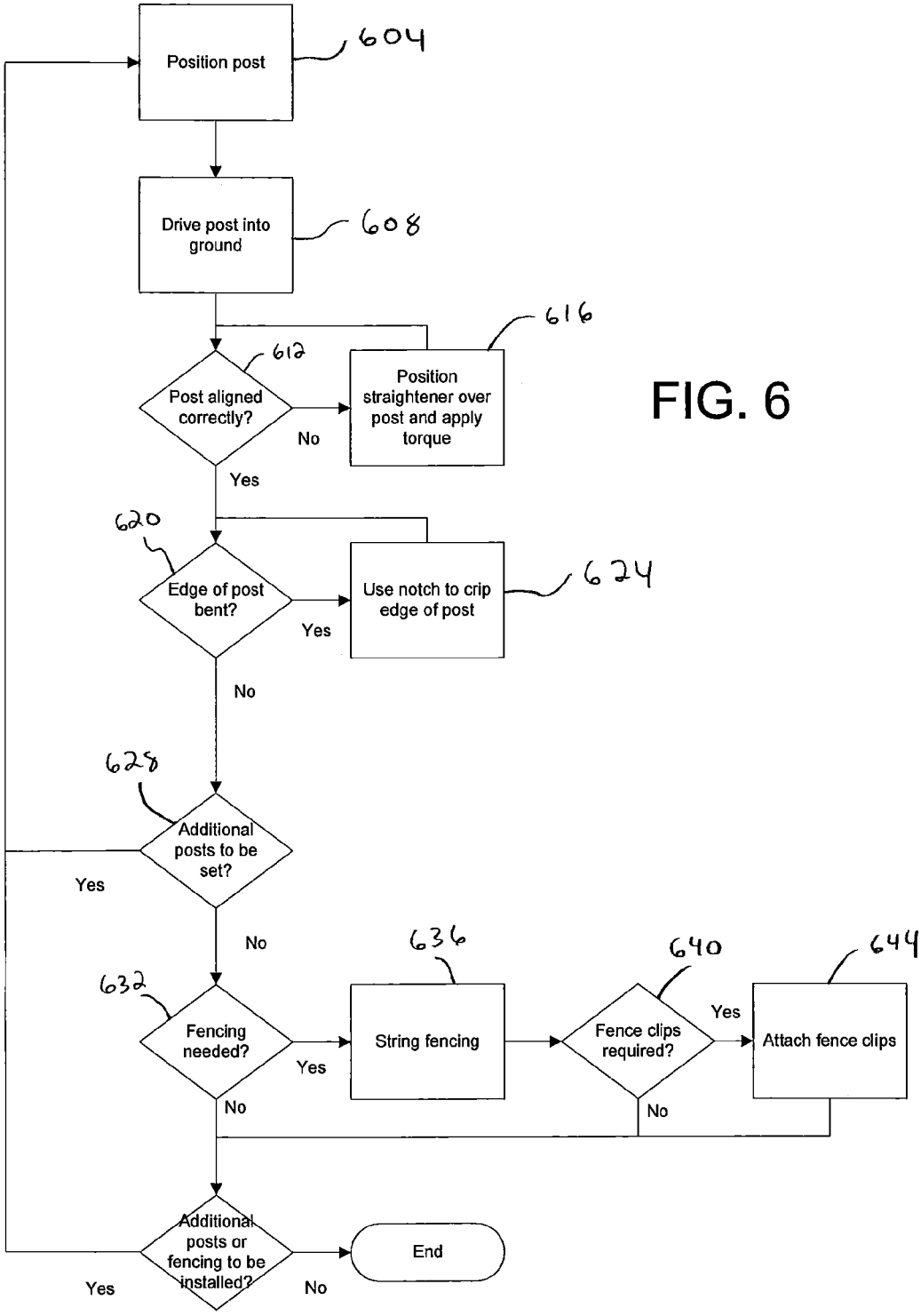
FIG. 6 is a flowchart depicting the steps of a method for aligning fence posts in accordance with embodiments of the present invention.

FIG. 6 is a flow chart depicting aspects of a method for setting and aligning a fence post 104 in accordance with embodiments of the present invention. Initially, a fence post 104 is positioned at a desired location (step 604). The fence post 104 is then driven into the ground (step 608). Driving the fence post 104 into the ground can include placing the open end 136 of a post pounder 132 comprising the lever arm 120 of an alignment tool 100 in accordance with embodiments of the present invention over the fence post 104 such that the fence post 104 is received by the bore 216, lifting the post pounder 132 such that the stop 218 at or adjacent the closed end 134 is raised above the top of the fence post 104, and allowing the post pounder 132 to drop onto the end of the fence post 104, driving the fence post 104 into the ground. As can be appreciated by one of skill in the art, lifting and dropping the post pounder 132 onto the fence post 104 can be repeated until the fence post 104 is driven to a desired depth.

At step 612, a determination is made as to whether the fence post 104 is aligned correctly. More particularly, it is desirable to align each fence post 104 such that the front plates 138 of the fence posts 104 in a fence line 108 are parallel or nearly parallel to each other. If it is determined that the fence post 104 is not aligned correctly, the alignment tool 100 can be placed over the fence post 104 and a torque can be applied to rotate or twist the fence post 104 into the desired alignment (step 616) (see FIG. 4). More particularly, the aperture 116 in the alignment plate 112 of the alignment tool 100 can be fitted over the fence post 104, and the alignment plate 112 can be brought to a desired location along the length of the fence post 104. Then, by applying a force to the lever arm 120, the aperture 116 in which the fence post 104 is captured can apply a torque to the fence post 104, twisting the fence post 104 into the desired alignment. This process can be repeated at the same or different locations along the length of the fence post 104, until the desired alignment is achieved. In addition, if desired, more than one alignment tool 100 can be used to apply torques, for example in opposite directions, to a fence post 104 to correct a twist along the length of the fence post 104.

Once it is determined at step 612 that the fence post 104 has been aligned correctly, a determination can be made as to whether an edge of the fence post 104 is bent (step 620). For example, as can be appreciated by one of skill in the art, the process of driving the fence post 104 into the ground can cause the top of the fence post 104 to become deformed. Alternatively or in addition, an edge of the fence post 104 may be deformed at other locations along the length of the fence post 104, for example due to damage or manufacturing variability. If it is determined that an edge of the fence post 104 is bent, a notch 128 in the alignment plate 112 of the alignment tool 100 can be used to crimp or otherwise bend the affected edge into a desired alignment or configuration (step 624). More particularly, a notch 128 can be positioned to receive the affected edge and, by applying a force through the lever arm 120, the edge can be realigned (see FIG. 5). This process can be repeated at one or more locations along the length of the fence post 104 until the edges of the fence post 104 are satisfactorily aligned.

After it has been determined at step 620 that the edges of the fence post 104 have been satisfactorily aligned, a determination may be made as to whether additional fence posts 104 remain to be set (step 628). If additional fence posts remain to be set, the process may return to step 604.

If no additional fence posts 104 remain to be set, a determination may be made as to whether fencing 140 is to be installed (step 632). If fencing is to be installed, the fencing 140 (e.g., the wire) can be attached to an end post 104 and strung across the appropriate intermediate fence post or posts 104 to a second end post (step 636).

After stringing the fencing 140, a determination may be made as to whether fence clips 144 are required (step 640). If fence clips are required, they may be attached (step 644). After attaching any required fence clips, or after determining that no fence clips are required, a determination may be made as to whether additional fence posts or fencing are to be installed (step 648). If additional fence posts or fencing are to be installed, the process may return to step 604. Alternatively, the process may end.

Although the method has been described as a series of steps in a particular order, it should be appreciated that embodiments of the present invention are not so limited. In particular, the described steps may be performed in different orders, as desired or required in a particular situation.

In the description set forth above, particular configurations of an alignment tool 100 have been described. However, embodiments of the present invention are not intended to be limited to those particular configurations. For example, an alignment plate 112 can include notches 128 at other locations along the periphery of the alignment plate 112. Moreover, an alignment plate can be provided that includes any number of notches 128, or no notches at all. In addition, although an alignment plate 112 with an aperture 116 having a cruciform shape has been illustrated, other shapes are possible. For example, a T-shaped aperture 116 can be provided. Other shapes, suitable for engaging a fence post 104, including fence posts that do not have a T-shaped cross-section, are possible. In particular, the shape of the aperture 116 can be any shape that will operatively engage the edges of a fence post 104, to allow a torque to be applied to that fence post 104.

In accordance with embodiments of the present invention, the alignment plate 112 and lever arm 120 can be formed from steel or other metallic alloys. In addition, the alignment plate 112 may be fixed to the lever arm 120 by welding. Alternatively or in addition, the alignment plate 112 may be mechanically attached to the lever arm 120. In accordance with still other embodiments, the alignment plate 112 may be provided as a separate component that can be attached to any suitable lever arm 120. Accordingly, the lever arm 120 can comprise a length of pipe, a post pounder or driver, a post puller, a wrench, or other implement.

The foregoing discussion of the invention has been presented for purposes of illustration and description. Furthermore, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best modes presently known of practicing the invention and to enable others skilled in the art to utilize the invention in such, or in other embodiments, and with the various modifications required by their particular application or use of the invention. It is intended that the appended claims be construed to include alternative embodiments to the extent permitted by the prior art.

What is claimed is:

1. An apparatus for adjusting posts, comprising:

an alignment plate, including:

an outer periphery; and a closed aperture contained within the outer periphery of the alignment plate, wherein the aperture is of a cruciform shape, and wherein the aperture is adapted to receive a post and to enable a torque to be applied to the post;

at least a first notch formed in the outer periphery of the alignment plate, wherein the at least a first notch is adapted to receive an edge of the post to realign the edge;

a lever arm, wherein a first end of the lever arm is fixed to the alignment plate, wherein the alignment plate defines a first plane, wherein a longitudinal axis of the lever arm is at least one of parallel to and in the first plane, wherein the lever arm further comprises a T-post pounder with a bore portion capable of receiving the post, and wherein the bore is terminated by a stop.

2. The apparatus of claim 1, further comprising a second notch formed in the outer periphery of the alignment plate that is adapted to receive an edge of a post, wherein the first notch and the second notch are formed on opposite sides of the alignment plate.

3. The apparatus of claim 1, wherein the lever arm further comprises a handle.

4. The apparatus of claim 1, wherein the lever arm comprises a plurality of handles adapted for driving a post.

* * * * *